US010041502B2

(12) United States Patent
Ye et al.

(10) Patent No.: US 10,041,502 B2
(45) Date of Patent: Aug. 7, 2018

(54) AIR BLOWER

(71) Applicant: Johnson Electric S.A., Murten (CH)

(72) Inventors: Xiao Hong Ye, Shenzhen (CN); Jing Li, Shenzhen (CN); Nan Li, Shenzhen (CN); Ching Hang Leung, Hong Kong (CN); Jian Jun Liu, Shenzhen (CN); Siu Chun Tam, Hong Kong (CN)

(73) Assignee: JOHNSON ELECTRIC S.A., Murten (CH)

( * ) Notice: Subject to any disclaimer, the term of this patent is extended or adjusted under 35 U.S.C. 154(b) by 521 days.

(21) Appl. No.: 14/699,792

(22) Filed: Apr. 29, 2015

(65) Prior Publication Data

US 2015/0308447 A1 Oct. 29, 2015

(30) Foreign Application Priority Data

Apr. 29, 2014 (CN) ..... 2014 1 0178686

(51) Int. Cl.

| | |
|---|---|
| ***F04D 29/28*** | (2006.01) |
| ***A47K 10/00*** | (2006.01) |
| ***F04D 25/06*** | (2006.01) |
| ***F04D 29/42*** | (2006.01) |
| ***A45D 20/00*** | (2006.01) |
| *A47K 10/48* | (2006.01) |

(52) U.S. Cl.

CPC ..... *F04D 29/281* (2013.01); *A45D 20/00* (2013.01); *A47K 10/00* (2013.01); *F04D 25/06* (2013.01); *F04D 25/0606* (2013.01); *F04D 29/4226* (2013.01); *F04D 29/4246* (2013.01); *F04D 29/4253* (2013.01); *A47K 10/48* (2013.01)

(58) Field of Classification Search

CPC ..... A47K 10/00; A47K 10/48; F04D 29/281; F04D 29/422; F04D 29/4253; F04D 29/4226; F04D 29/4246; F04D 26/06; F04D 25/0606; F04D 2250/52; F04D 17/10; A45D 20/00

USPC ..... 415/206; 417/423.14, 360

See application file for complete search history.

(56) References Cited

U.S. PATENT DOCUMENTS

2006/0133037 A1* 6/2006 Horng ..... H05K 7/2019 361/695

2011/0229350 A1 9/2011 He

FOREIGN PATENT DOCUMENTS

KR 10-0691227 3/2007

* cited by examiner

*Primary Examiner* — Jessica Yuen

(74) *Attorney, Agent, or Firm* — Muncy, Geissler, Olds & Lowe, P.C.

(57) ABSTRACT

An air blower includes an impeller, a motor and a blower housing. The blower housing includes a first housing member for receiving the motor and a second housing member for receiving the impeller. The first and second housing members are mounted to each other. Two opposed air outlets are formed at an end of the first housing member remote from the second housing member. Each air outlet is formed by an outwardly inclined cutout. The cutout is bounded by two inclined sides. An angle A formed by each inclined side and an axial direction of the blower is in the range from 0 to 45 degrees. Radial lines extending from one inclined side of one air outlet and the adjacent inclined side of the other air outlet form an angle B in the range from 15 to 45 degrees.

8 Claims, 7 Drawing Sheets

| Hole Diam | Current | Input power (W) | | Speed | Vacuum | Corr. Vacuum | Flow rate | Suction | Efficiency |
|---|---|---|---|---|---|---|---|---|---|
| mm (d) | A | power | corrected | RPM | mmH20 (hm) | mmH20 (h) | l/sec (q) | Air Watts | % |
| 63.5 | 6.46 | 742.4 | 749.5 | 33612 | 18.7 | 18.9 | 33.59 | 6.2 | 0.8 |
| 57.2 | 6.46 | 740.9 | 748.0 | 33694 | 29.9 | 30.3 | 34.32 | 10.2 | 1.4 |
| 50.8 | 6.48 | 742.7 | 749.8 | 33642 | 47.6 | 48.2 | 34.29 | 16.2 | 2.2 |
| 44.5 | 6.40 | 732.6 | 739.6 | 33660 | 81.0 | 82.0 | 34.15 | 27.4 | 3.7 |
| 38.1 | 6.40 | 732.3 | 739.3 | 33701 | 145.5 | 147.4 | 33.17 | 47.9 | 6.5 |
| 34.9 | 6.36 | 727.9 | 734.9 | 33757 | 197.2 | 199.7 | 32.65 | 63.9 | 8.7 |
| **31.7** | **6.36** | **729.6** | **736.6** | **33978** | **276.3** | **278.9** | **31.80** | **86.9** | **11.8** |
| 28.6 | 6.27 | 718.6 | 725.5 | 34173 | 378.8 | 383.7 | 30.18 | 113.4 | 15.6 |
| 25.4 | 6.15 | 706.4 | 713.2 | 34675 | 527.6 | 534.4 | 27.97 | 146.4 | 20.5 |
| 22.2 | 5.88 | 676.8 | 683.3 | 35545 | 708.0 | 717.1 | 24.59 | 172.7 | 25.3 |
| 19.0 | 5.63 | 649.0 | 655.2 | 36302 | 921.3 | 933.1 | 20.54 | 187.7 | 28.6 |
| 15.8 | 5.32 | 614.6 | 620.5 | 37394 | 1127.1 | 1141.5 | 15.72 | 175.8 | 28.3 |
| 12.7 | 4.89 | 566.2 | 571.6 | 39095 | 1180.9 | 1196.1 | 10.26 | 120.1 | 21.0 |
| 9.5 | 4.56 | 529.9 | 535.0 | 40586 | 1255.5 | 1271.6 | 6.08 | 75.7 | 14.1 |
| 6.3 | 4.14 | 481.3 | 485.9 | 41599 | 1290.9 | 1307.4 | 2.90 | 37.1 | 7.6 |
| 0.0 | 3.62 | 419.0 | 423.0 | 42066 | 1292.2 | 1308.7 | 0.00 | 0.0 | 0.0 |
| Wide open | 6.46 | 738.7 | | 33562 | 5.7 | | | | |

FIG. 7 (Prior Art)

| Hole Diam | Current | Input power (W) | | Speed | Vacuum | Corr. Vacuum | Flow rate | Suction | Efficiency |
|---|---|---|---|---|---|---|---|---|---|
| mm (d) | A | power | corrected | RPM | mmH20 (hm) | mmH20 (h) | l/sec (q) | Air Watts | % |
| 63.5 | 4.94 | 580.2 | 590.2 | 31702 | 24.7 | 25.2 | 38.78 | 9.6 | 1.6 |
| 57.2 | 4.94 | 580.3 | 590.3 | 31807 | 39.1 | 40.0 | 39.37 | 15.4 | 2.6 |
| 50.8 | 4.97 | 584.1 | 594.2 | 31770 | 62.5 | 63.9 | 39.35 | 24.6 | 4.1 |
| 44.5 | 4.94 | 580.6 | 590.6 | 31842 | 102.9 | 105.3 | 38.55 | 39.7 | 6.7 |
| 38.1 | 4.95 | 581.4 | 591.4 | 32425 | 179.4 | 183.5 | 36.87 | 66.3 | 11.2 |
| 34.9 | 4.89 | 574.4 | 584.3 | 32088 | 235.2 | 240.7 | 35.69 | 84.1 | 14.4 |
| **31.7** | **4.86** | **671.2** | **681.1** | **32226** | **314.6** | **321.8** | **34.04** | **107.3** | **18.6** |
| 28.6 | 4.81 | 566.7 | 576.5 | 33065 | 412.6 | 422.1 | 31.56 | 130.5 | 22.6 |
| 25.4 | 4.66 | 549.4 | 558.9 | 33002 | 528.9 | 541.1 | 28.13 | 149.1 | 26.7 |
| 22.2 | 4.53 | 535.3 | 544.5 | 33975 | 653.7 | 668.8 | 23.77 | 155.7 | 28.6 |
| 19.0 | 4.28 | 506.5 | 515.2 | 34620 | 785.5 | 803.5 | 19.11 | 150.4 | 29.2 |
| 15.8 | 4.02 | 476.7 | 484.9 | 35937 | 908.5 | 929.4 | 14.25 | 129.7 | 26.8 |
| 12.7 | 3.70 | 440.3 | 447.9 | 37359 | 1026.4 | 1050.0 | 9.63 | 99.0 | 22.1 |
| 9.5 | 3.45 | 410.9 | 418.0 | 38630 | 1118.8 | 1144.6 | 5.80 | 65.0 | 15.5 |
| 6.3 | 3.28 | 391.7 | 398.5 | 39464 | 1173.8 | 1200.8 | 2.80 | 32.9 | 8.3 |
| 0.0 | 3.05 | 364.6 | 370.9 | 40500 | 1214.6 | 1242.5 | 0.00 | 0.0 | 0.0 |
| Wide open | 4.96 | 592.2 | | 32098 | 8.7 | | | | |

FIG. 8

AIR BLOWER

CROSS REFERENCE TO RELATED APPLICATIONS

This non-provisional patent application claims priority under 35 U.S.C. § 119(a) from Patent Application No. 201410178686.3 filed in The People's Republic. of China on Apr. 29, 2014, the entire contents of which are hereby incorporated by reference.

FIELD OF THE INVENTION

This invention relates to an air blower and to a hand dryer incorporating the blower.

BACKGROUND OF THE INVENTION

Known air blowers usually include a housing and a motor and impeller accommodated in the housing. As shown in FIG. 1, the housing 1 includes a motor housing member 11 receiving the motor and an impeller housing member 12 receiving the impeller. The impeller housing member 12 and the motor housing member 11 are connected together. The impeller housing member 12 defines an opening 13 as an air inlet. The motor housing 11 defines a plurality of openings 14 as air outlets. The openings 14 are formed by cutouts parallel to an axis of the motor housing member 11 and are evenly arranged on an outer circumferential surface of the motor housing member 11.

During operation the motor drives the impeller to generate a pressurized airflow which is exhausted through the openings 14. This type of blower is commonly used in appliances such as hand dryers and vacuum cleaners. For example, the blowers used in hand dryers are required to deliver a large airflow to quickly dry hands and to have a small size to occupy a small space in the washrooms. However, there is a large air resistance to the pressurized airflow discharged from the air outlets, which causes the conventional blower to have a small airflow. In order to increase the airflow, an input power of the blower must be increased. As a result, the blower has a low overall efficiency. In addition, the blower has a large size.

Thus, there is a desire for a blower with increased efficiency and reduced size.

SUMMARY OF THE INVENTION

Accordingly, in one aspect thereof, the present invention provides an air blower including an impeller, a motor and a blower housing. The blower housing includes a first housing member for receiving the motor and a second housing member for receiving the impeller. The first housing member and the second housing member are fixedly mounted to each other and are in flow communication with each other. Two opposed air outlets are formed at an end of the first housing member away from the second housing member. Each of the air outlets is formed by an outwardly inclined cutout. The cutout is bounded by two inclined sides, an angle formed by each inclined side and an axial direction of the first housing member is in the range from 0 to 45 degrees, and one inclined side of one air outlet and one adjacent inclined side of the other air outlet form an angle B in the range from 15 to 45 degrees.

Preferably, each of the air outlets has a height H1, the height of a top of the each of the air outlets with respect to a bottom of the first housing member is H2, and the ratio of H1 to H2 is in the range from 20/77.3 to 46/77.3.

Preferably, in a particular embodiment, the angle B is 45 degree, and the ratio of H1 to H2 is 43/73.

Preferably, the first housing member is a hollow cylinder, and an end of the cylinder away from the second housing member is connected with an end bracket.

Preferably, a boss is disposed on the end bracket, and the boss defines through hole for receiving a bearing therein.

Preferably, the second housing member comprises a circular sidewall, one end of the circular sidewall is connected to the first housing member through a flange, and the other end of the circular sidewall is connected to a bottom cover.

Preferably, an air inlet is formed at a center of the bottom cover.

The present invention further provides a hand dryer having a blower as described above.

By deliberately configuring the shape of the air outlets of the blower housing to increase the size of the air outlets, the air resistance during operation of the blower is reduced, thereby increasing the airflow through the blower at a lower input power. In addition, this allows the size of the blower to be reduced the same airflow.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

FIG. 7 is a table showing the specifics of a conventional blower; and

FIG. 8 is a table showing the specifics of the blower according to the preferred embodiment of the present invention.

DETAILED DESCRIPTION OF THE PREFERRED EMBODIMENTS

Figure 1:
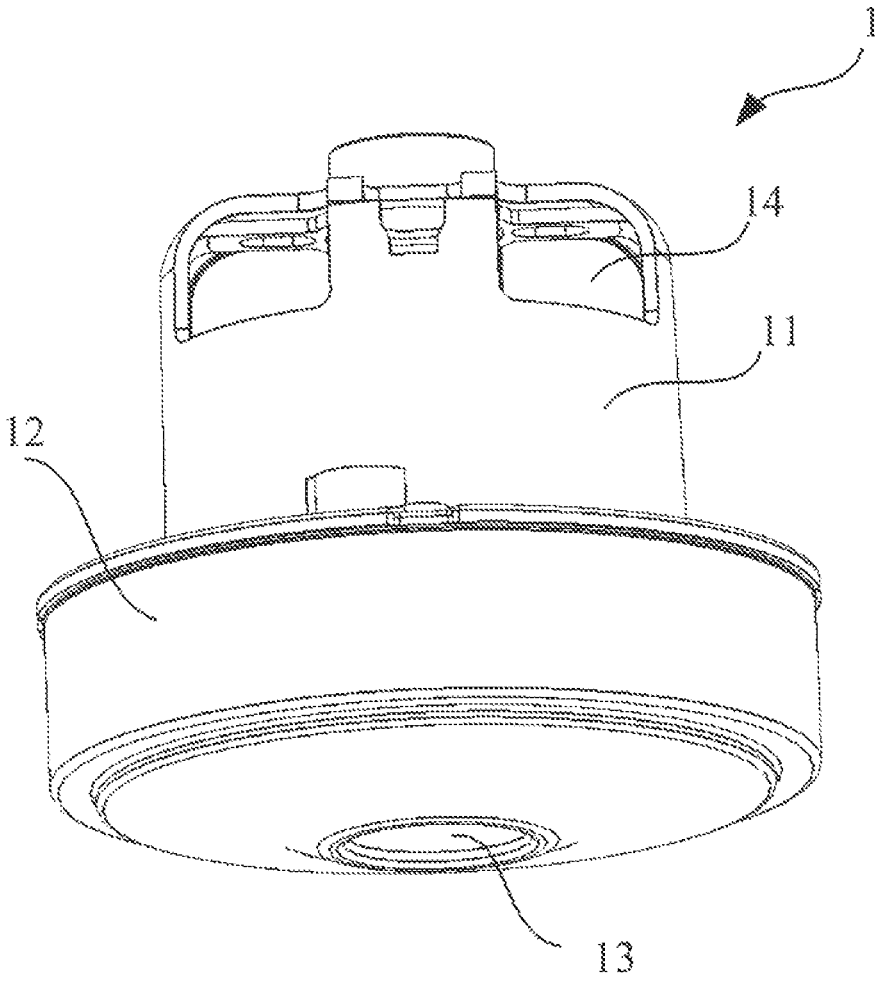
FIG. 1 (Prior Art)
FIG. 1 is a perspective view of a conventional blower housing.

An air blower in accordance with the preferred embodiment of the present invention may be used, for example, in appliances such as a hand dryer. The blower includes an impeller, a motor, and a blower housing. Referring to FIGS. 2 to 6, the blower housing 2 includes a first housing member 21 for accommodating the motor and a second housing member 22 for accommodating the impeller. The first housing member 21 and the second housing member 22 are fixedly connected to each other and are in air flow communication with each other. Preferably, the second housing member 22 includes a circular sidewall. One end of the circular sidewall is connected to the first housing member 21 through a flange 23, and the other end is connected to a bottom cover 221. An air inlet 222 is formed in the bottom cover 221, for introducing air into the blower. In addition, the first housing member 21 is a hollow cylinder. An end of the cylinder remote from the second housing member 22 is mounted with an end bracket 213. A boss 214 is disposed on the end bracket 213. A hole is defined in the boss 214, for receiving a bearing therein. Optionally, where the first housing member is a moulded part, the end bracket may be integrally formed with the first housing part as a monolithic structure.

Two opposed air outlets 211 are formed at an end of the first housing member 21 away from the second housing member 22. Each air outlet 211 is formed by an outwardly inclined cutout. The cutout is bounded by two inclined sides 212 and one bottom side. The bottom side is substantially perpendicular to the axis of the first housing member 21.

Figure 2:
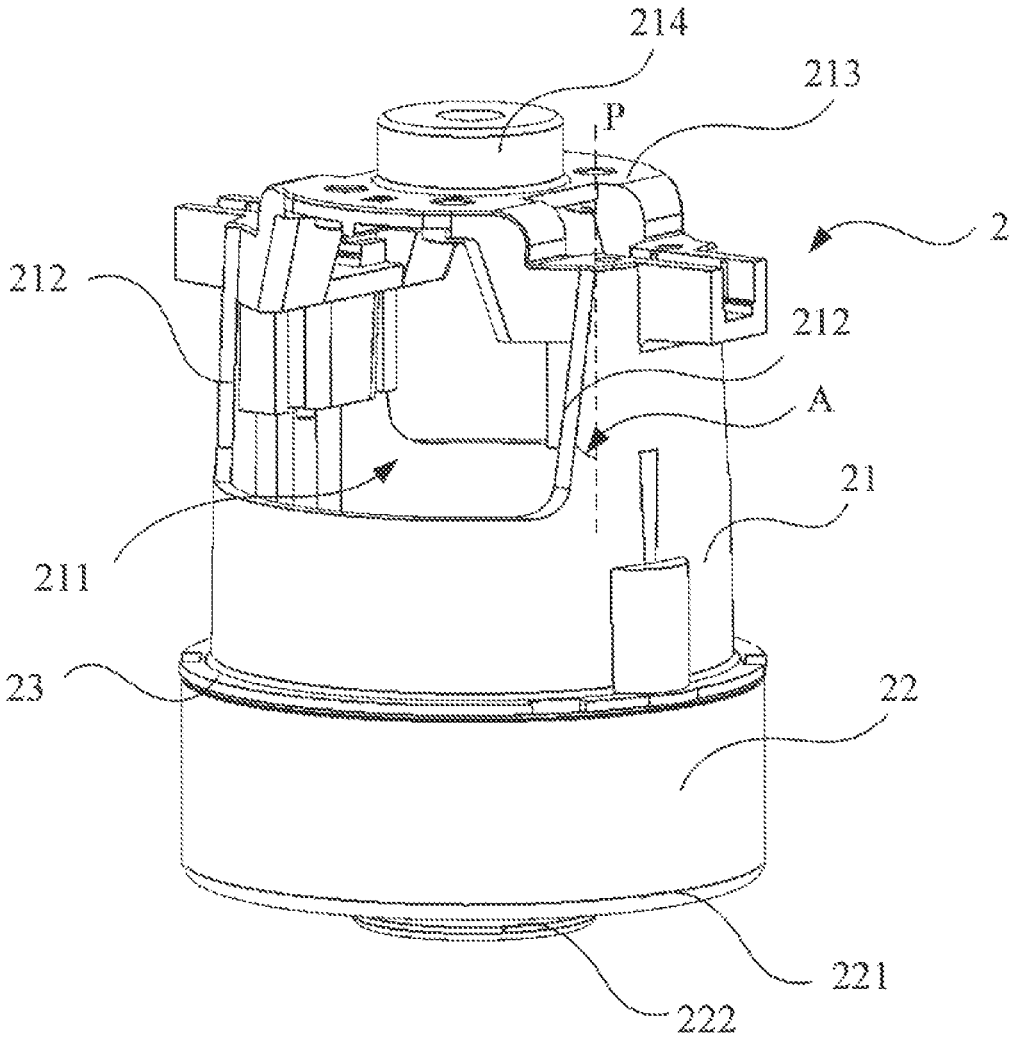
FIG. 2 is a perspective view of a blower housing according to the preferred embodiment of the present invention.
Figure 3:
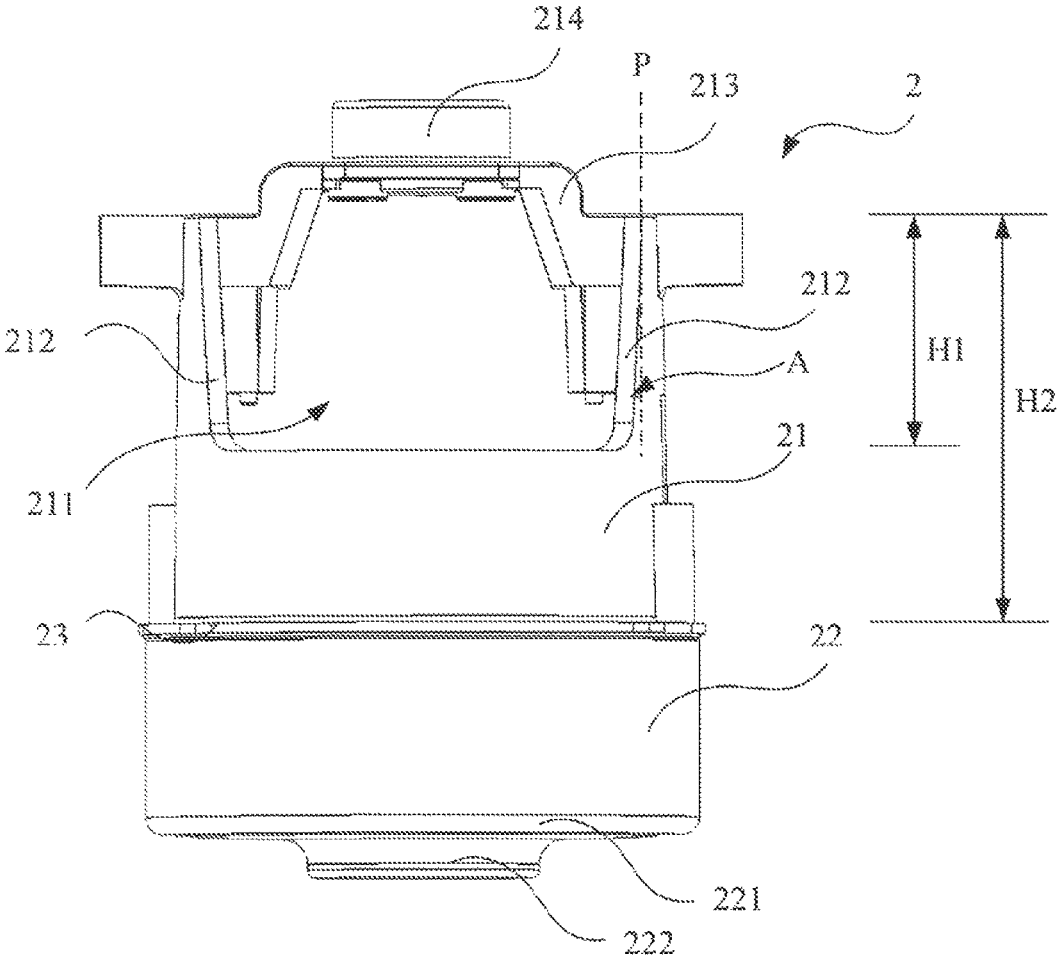
FIG. 3 is a front view of the blower housing of FIG. 2.
Figure 4:
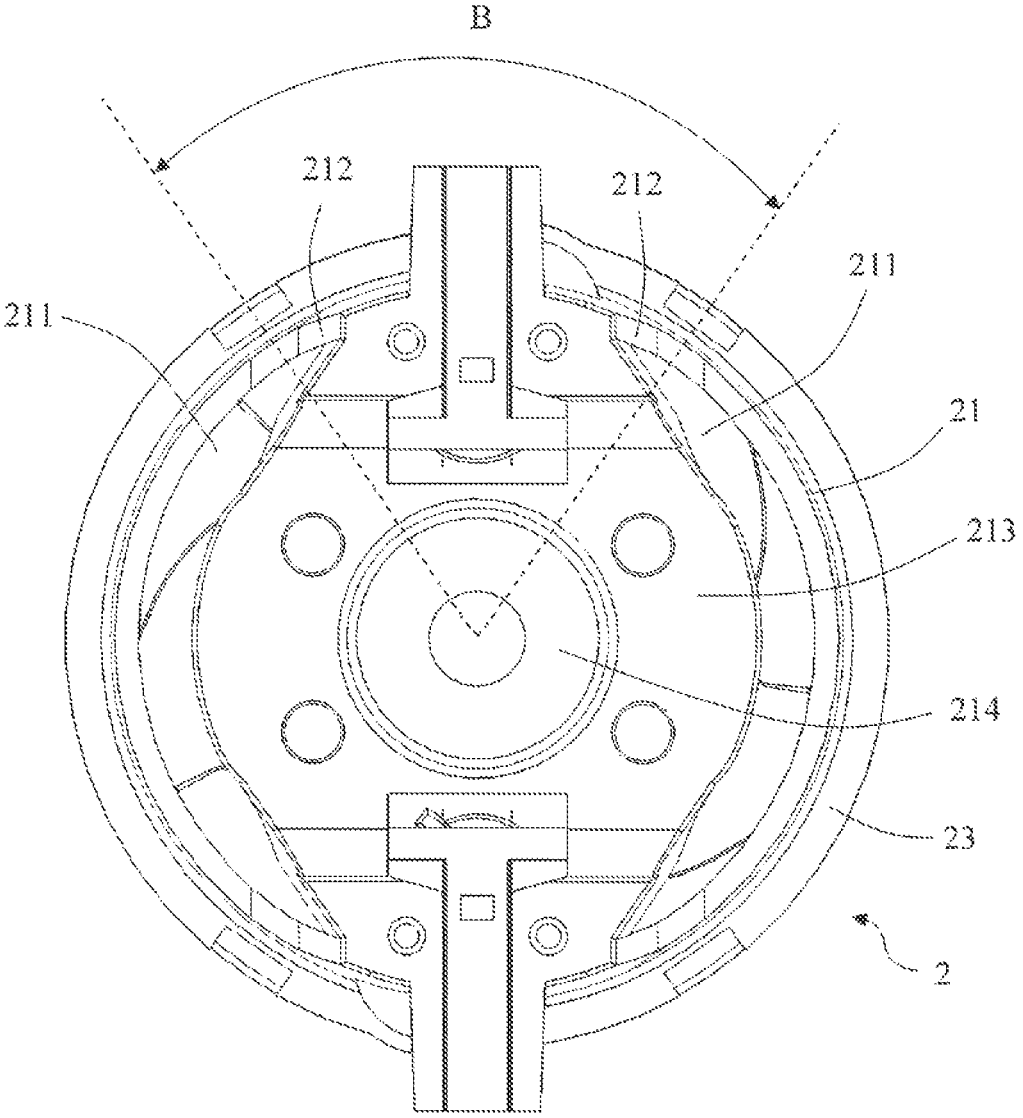
FIG. 4 is a plan view of the blower housing of FIG. 7.

An angle A formed by each inclined side 212 and an axial direction of the first housing member 21 is in the range from 0 and 45 degrees, i.e. the angle A between one inclined side 212 and a line P, shown in FIG. 2 to FIG. 4, is in the range from 0 and 45 degrees, the line P being parallel to the axis of the first housing member 21. It will be realised that the first housing member and the motor are coaxial or at least have axes which are parallel and thus line P is also parallel to the axis of the blower.

As shown in FIG. 4, the radial lines passing through the base of one inclined side 212 of one air outlet 211 and the base of the adjacent inclined side 212 of the other air outlet 211 form an angle B in the range from 15 to 45 degrees. The base of the inclined wall is the point where the inclined side meets the bottom side of the cutout, ignoring any fillet or radius formed at the junction. The combination of the angle A and angle B within these ranges can effectively reduce air resistance, increase airflow and reduce input power and blower speed, thereby enhancing the blower efficiency and prolonging the lifespan of the blower. In addition, the blower can still satisfy the airflow and pressure requirements even though the blower diameter is reduced. By minimising angle B, the width of the air outlets are maximised. A minimum angle B is required to support the end bracket and the brushes.

In the chosen embodiment, each air outlet 211 has a height H1, the first housing member has a height H2, and a ratio of H1 to H2 is in the range from 20/77.3 to 46/77.3. The ratio within this range can result in a significantly increased airflow and/or reduced input power.

In particular, when the angle B is 45 degrees, the ratio of H1 to H2 is 43/73, the maximum airflow of the blower can reach 40 L/S, and the input power of the blower is significantly reduced from the initial 736 W to 571 W; the speed of the blower is reduced from the original 33,978 RPM to 32,226 RPM; the blower efficiency is also enhanced. Thus, the blower lifespan can be improved. This is a significant breakthrough especially for blowers having a diameter less than 90 centimeters.

Figure 5:
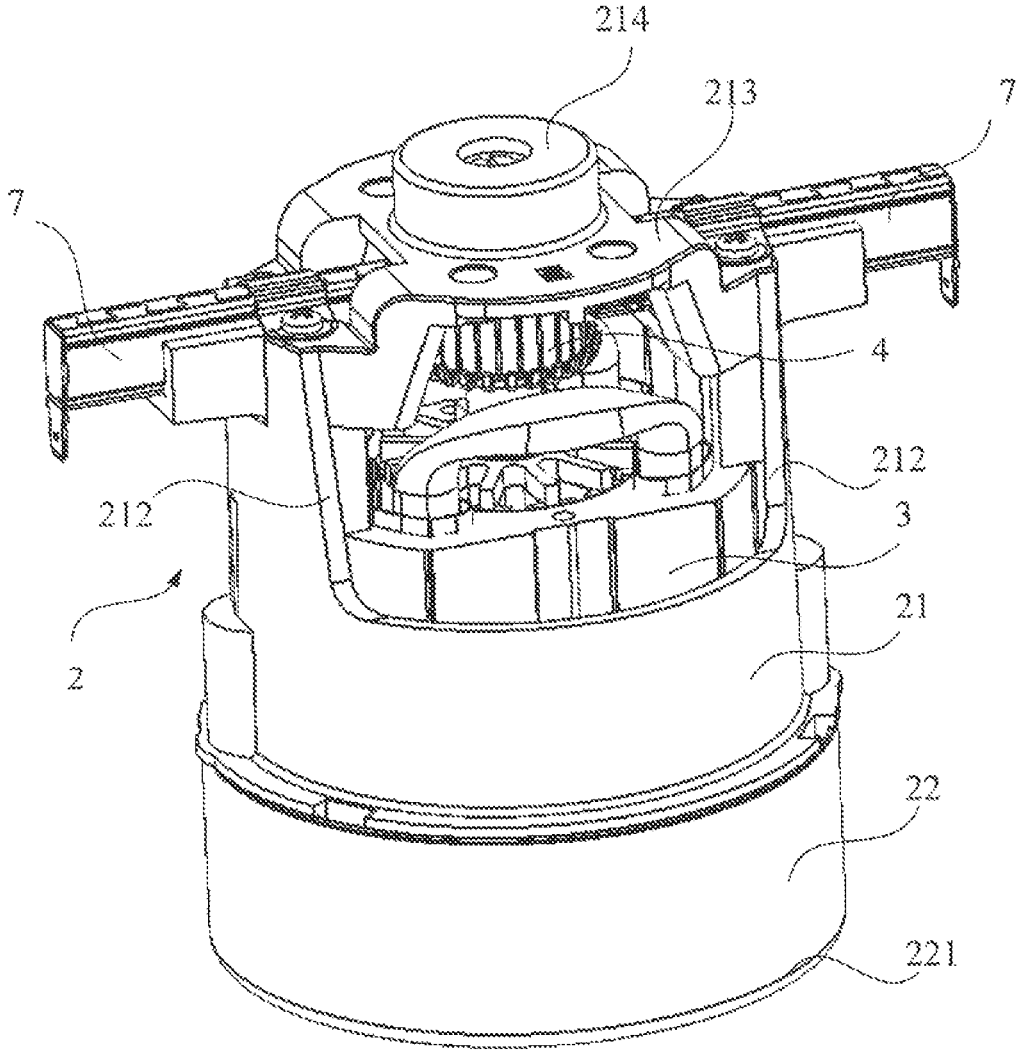
FIG. 5 is a perspective view of an air blower incorporating the blower housing of FIG. 2.
Figure 6:
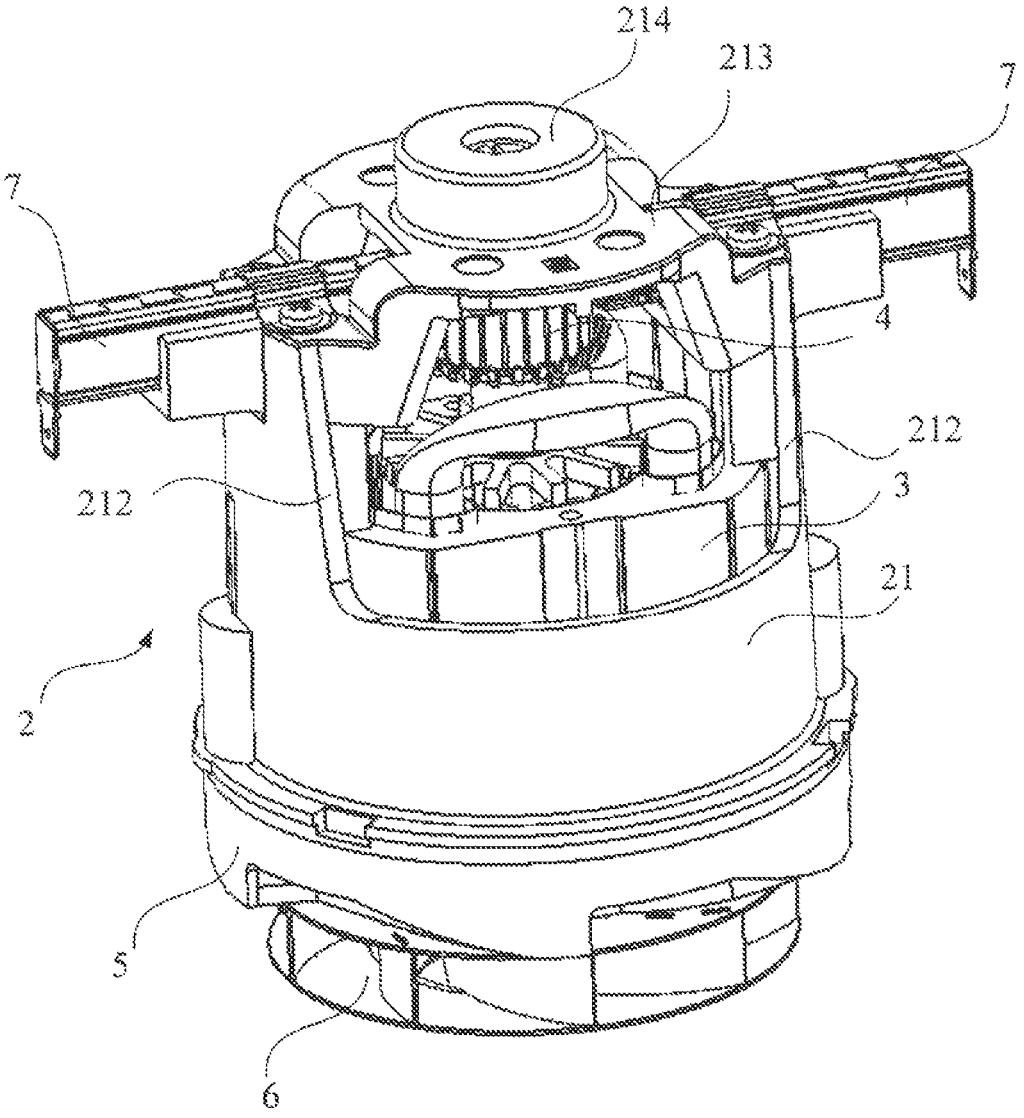
FIG. 6 shows the blower of FIG. 5 with a part removed.

Referring to FIGS. 5 and 6, the blower includes a motor 3, diffuser 5 and impeller 6 mounted in the blower housing 2. The motor illustrated is a universal motor having a wound stator and a wound rotor including a commutator 4. The motor 3 is mounted in the first housing member 21, which also supports brushes 7 which make sliding contact with the commutator. The rotor is supported by the bearing of the boss 214 and another bearing (not shown) fixed to the diffuser. Two brushes 7 are disposed at diametrically opposed sides of the commutator 4. The diffuser 5 and impeller 6 are sequentially disposed at the bottom of the motor 3 and are received in the second housing member 22. The impeller 6 is fixed to the shaft of the motor 3 to generate airflow when the motor operates. The diffuser 5 is disposed downstream of the impeller 6 in the airflow direction.

Referring to FIG. 7 and FIG. 8, comparison results between an existing blower and the blower of the present invention are shown. In this comparison, the air inlet of the existing blower and the air inlet of the blower of the present invention have the same diameter of 31.7 mm. The input power of the blower of the present invention is significantly less than the input power needed for the existing blower. Accordingly, the efficiency of the blower of the present invention is significantly neater than the efficiency of the existing blower.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. An air blower comprising: an impeller, a motor and a blower housing, wherein the blower housing comprises a first housing member for receiving the motor and a second housing member for receiving the impeller, the first housing member and the second housing member are mounted to each other and are in air flow communication with each other;

two opposed air outlets are formed at an end of the first housing member remote from the second housing member, each air outlet is formed by an inclined cutout, the cutout is defined between two inclined sides;

an angle A formed between each inclined side and an axial direction of the first housing member is greater than 0 degree and less than or equal to 45 degrees; and an angle B formed by radial lines extending from the base of one inclined side of one air outlet and the base of the adjacent inclined side of the other air outlet is in the range from 15 to 45 degrees, wherein each of the air outlets has a height H1, the height of a top of the each of the air outlets with respect to a bottom of the first housing member is H2, and the ratio of H1 to H2 is in the range from 20/77.3 to 46/77.3.

2. The blower of claim 1, wherein the angle B is 45 degree, and the ratio of H1 to H2 is 43/73.

3. The blower of claim 1, wherein the first housing member is a hollow cylinder, and an end of the cylinder remote from the second housing member is connected with an end bracket.

4. The blower of claim 3, wherein a boss is disposed on the end bracket, and the boss has a hole for receiving a bearing therein.

5. The blower of claim 1, wherein the second housing member comprises a circular sidewall, one end of the circular sidewall is connected to the first housing member through a flange, and the other end of the circular sidewall is connected to a bottom cover.

6. The blower of claim 5, wherein an air inlet is formed in the bottom cover.

7. The blower of claim 1, wherein the motor is a universal type motor.

8. A hand dryer incorporating the blower of claim 1.

* * * * *